US007008337B2

(12) United States Patent
Kershaw

(10) Patent No.: US 7,008,337 B2
(45) Date of Patent: Mar. 7, 2006

(54) BASKETBALL RETURN DEVICE

(76) Inventor: Thomas R. Kershaw, 5626 Riverside Dr., Cape Coral, FL (US) 33904

( * ) Notice: Subject to any disclaimer, the term of this patent is extended or adjusted under 35 U.S.C. 154(b) by 0 days.

(21) Appl. No.: 10/883,189

(22) Filed: Jul. 2, 2004

(65) Prior Publication Data

US 2006/0003855 A1 Jan. 5, 2006

(51) Int. Cl.
*A63B 69/00* (2006.01)

(52) U.S. Cl. ..... 473/433; 473/447

(58) Field of Classification Search ..... 473/433, 473/435, 447, 472, 485, 479
See application file for complete search history.

(56) References Cited

U.S. PATENT DOCUMENTS 4,720,101 A * 1/1988 Farkas, Jr. ..... 473/433
D308,237 S * 5/1990 McCullough ..... D21/704
5,098,090 A * 3/1992 Juhl ..... 473/433
5,184,814 A * 2/1993 Manning ..... 473/433
5,348,290 A * 9/1994 Matherne et al. ..... 473/433
D351,880 S * 10/1994 Taylor et al. ..... D21/704
5,779,569 A * 7/1998 Townsend et al. ..... 473/433

* cited by examiner

*Primary Examiner*—Mitra Aryanpour

(57) ABSTRACT

A basketball return device is formed of an injection molded device which is formed as a resilient deflector including a spine extending the length of the device. The spine has a pair of upper and lower wings which are located behind a net suspended from a hoop rim. The spine is flattened throughout its downward length and has intermittent elongated openings therein to enhance its torque and stability with regard to elasticity. The spine has attached thereto upper and lower lateral wings. The surface of each of the wings exhibit a flat surface directed toward a player. Extending surfaces of each of the wings are slanted inwardly from an edge thereof to improve the quality of the return of a ball being thrown.

4 Claims, 4 Drawing Sheets

BASKETBALL RETURN DEVICE

CROSS REFERENCE TO RELATED APPLICATIONS (none)

STATEMENT REGARDING FED SPONSORED R & D (none)

BACKGROUND OF THE INVENTION

Many activities suggested for devices for returning a basketball shot that was successfully shot into a basket to a shooter. Several variations on ball return chutes disposed below a basketball rim have been suggested such as can be found in U.S. Pat. Nos. 2,808,264; 3,814,421; 3,945,638; and 4,579,339; and Steele's U.S. Pat. No. 3,799,543 which suggests a resilient ball deflector disposed behind the net which is magnetically attached to the underside of the rim. So far as can be determined, none of the above cited references are presently available in the marketplace, and all of them involve substantial problems such as complexity, expense, installation costs, disablement of the basket toward different directions from which the ball is thrown. Attention is directed to applicant's own U.S. Pat. No. 4,706,954 which discloses and claims the basic concept of this invention in that the inventive device overcomes these problems in that it is quickly and easily installed on most basketball baskets where it effectively returns balls to the shooters throughout a reasonably wide center court shooting arc.

SUMMARY OF THE INVENTION

The inventive basketball return device is formed of flexible elements having at a top thereof a pair of rim hooks, a bracket brace and a ball deflector. The rim hooks are spaced apart and hook over a basketball rim on opposite sides of a bracket supporting the basketball rim on a backboard. A pair of flexible loops extend downwardly from the hooks and upwardly to the brace, which is spaced from the rim to engage the underside of the rim support bracket.

The ball deflector extends downwardly from the brace to an upper wing which is curved around the backside of a net hanging on the rim and further downward to a lower wing disposed underneath a bottom opening of the net. The way that the upper region of the inventive device is resiliently braced and connected to the basket disposes the upper and lower wings flexibly behind and beneath the net when they are shaped for resiliently returning basketballs back toward their shooters.

The inventive device of the present invention differs from prior devices in that the inventive device includes a continuous flexible spine. The inventive device has to be molded and cannot be formed from a single and elongated rod. The spine of the inventive device is somewhat widened throughout its length and has intermediate openings thereon (explained below). Furthermore, the upper and lower wings are also somewhat widened to exhibit and expose a surface toward the trajectory of an incoming ball. This surface is not merely flat but is slanted inwardly toward the interior opening of the wing. The functions and advantages of these enumerated features will be explained below.

Another advantage of using a widened spine is that it limits the area within the looped wings to allow a proper function with the use of smaller diameter balls that are available to different groups of player.

Another advantage of using a widened spine is that the center spine is shaped and sized to benefit its visibility when postured behind the net when looking from the free throw line.

The central widened spine includes elongated slots or similar alignment features throughout its vertical extension to provide a sighting track feature and targeting aid to benefit the shooter.

DETAILED DESCRIPTION OF THE DRAWINGS

DETAILED DESCRIPTION OF THE INVENTION

Figure 1:
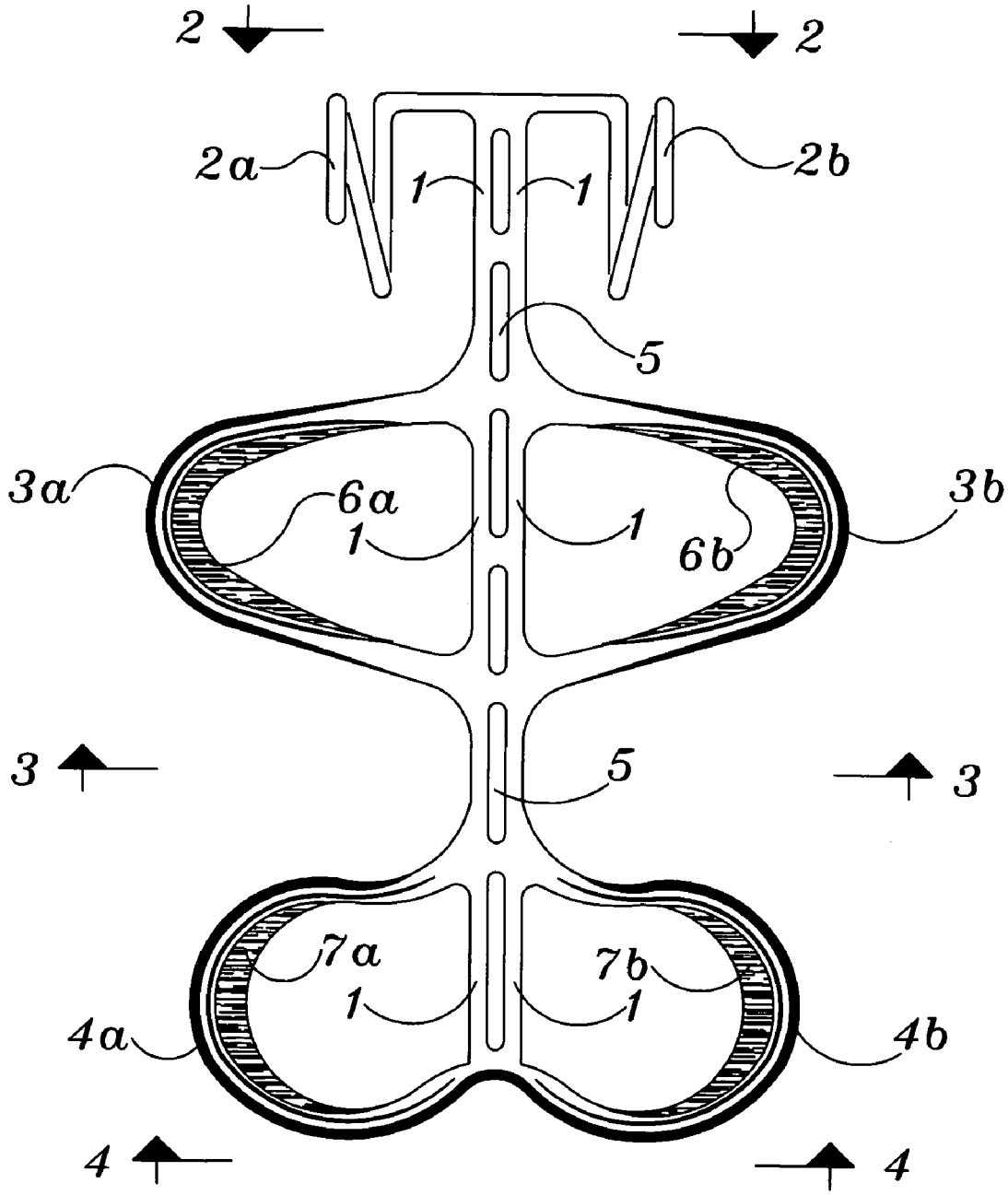
FIG. 1 is a direct view onto the basketball return device.

FIG. 1 illustrates a front view of the basketball return device and showing a backbone or a spine 1 that extends throughout the elongated length of the device. The spine of the deflector has elongated openings 5 therein, the purpose of which will be explained below. The spine 1 is the single supporting element of the device and is centrally located. The upper end of the deflector has left 2*a* and right 2*b* hooks thereon to be mounted over the rim of the basket or a brace 10 supporting the same (explained below). The deflector itself has upper left 3*a* and upper right wings 3*b* thereon that extends outwardly behind a net. The lower end of the deflector has lateral wings 4*a* (left) and 4*b* right extending therefrom. Both of the lateral wings have surfaces that are slanted inwardly 6*a* and 6*b* on the upper wing 3*a* and 3*b* and 7*a* and 7*b* on the lower wing 4*a* and 4*b*. The advantage of these inward slants is that if a curvature of a ball surface hits any of these slants, the trajectory of the ball that was tossed will be directed toward a central court direction.

Figure 2:
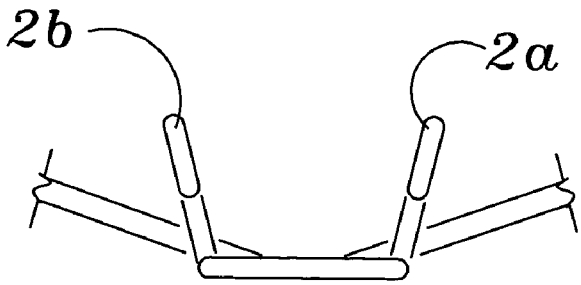
FIG. 2 is an elevational view of an upper region of the device of FIG. 1.

FIG. 2 is a top view of the upper region of the device of FIG. 1. The right 2*a* and left 2*b* mounting hooks are clearly visible.

Figure 3:
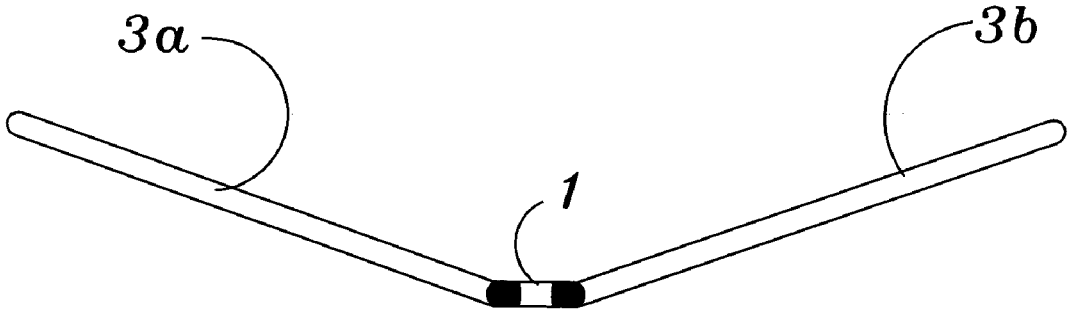
FIG. 3 is a cross sectional view illustrating the upper wing of the deflector device.

FIG. 3 is a cross sectional view illustrating the contour of the deflector as it pertains to the upper lateral wings 3*a* and 3*b* relative to the spine 1. In this FIG. 3 it can be seen that the wings 3*a* and 3*b* are directed forward form a plane including the spine 1.

Figure 4:
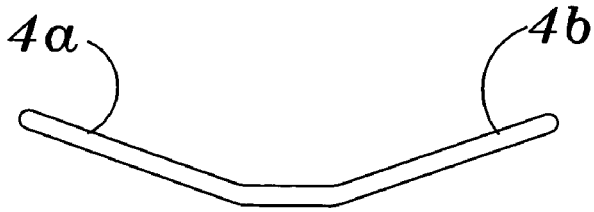
FIG. 4 is a bottom view of the lower wing of the deflector device.

FIG. 4 is a bottom view (upwardly) onto the lower wings 4*a* and 4*b*. These wings 4*a* and 4*b* are most effective in returning the thrown ball to the shooter because the wings are located below the net opening.

Figure 6:
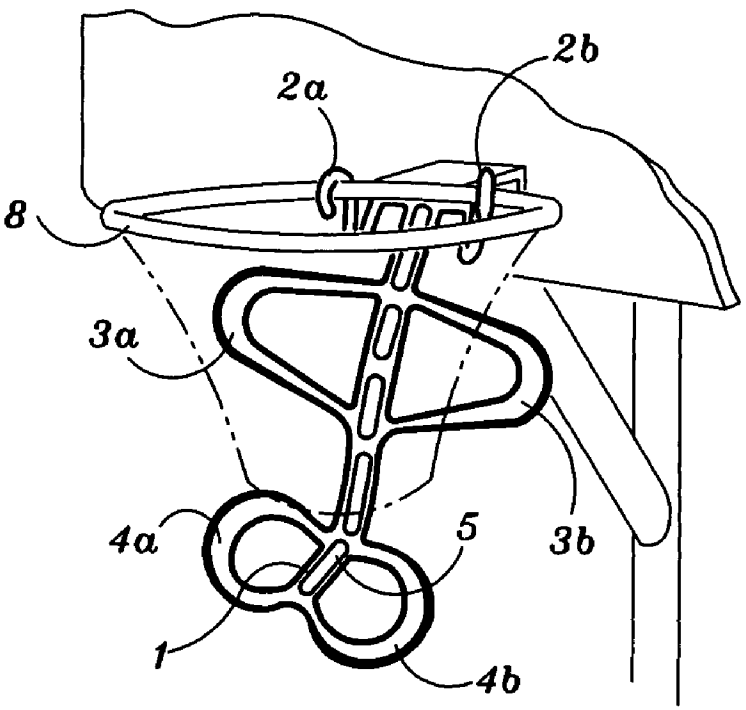
FIG. 6 illustrates the device of FIG. 5 but without the net.
Figure 5:
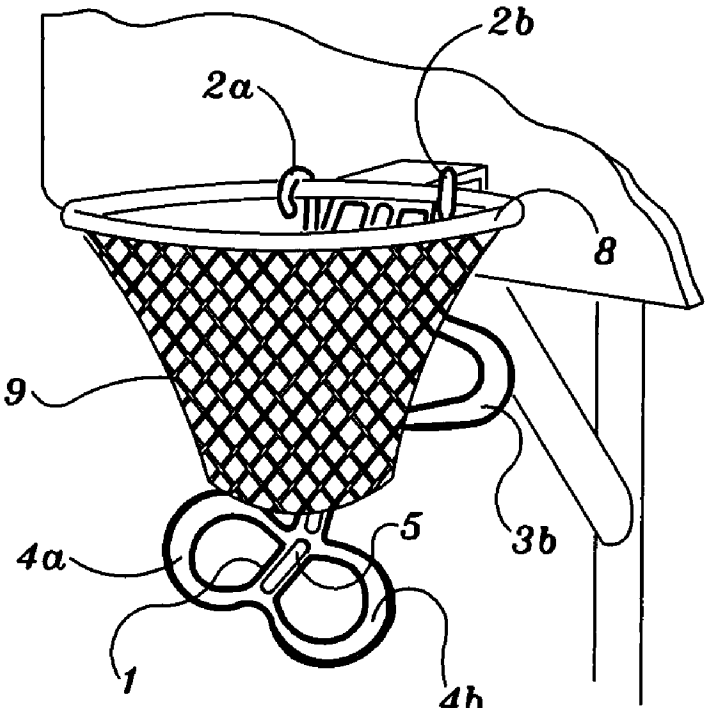
FIG. 5 illustrates the deflector device being installed on a regulation scenario.

FIG. 5 is a perspective view of the deflector including a net 9. As can be seen, the deflector is hooked over the rim 8 by way of the hooks 2*a* and 2*b* as can more clearly be seen in FIG. 6 illustrating the ball return without a net.

Figure 7:
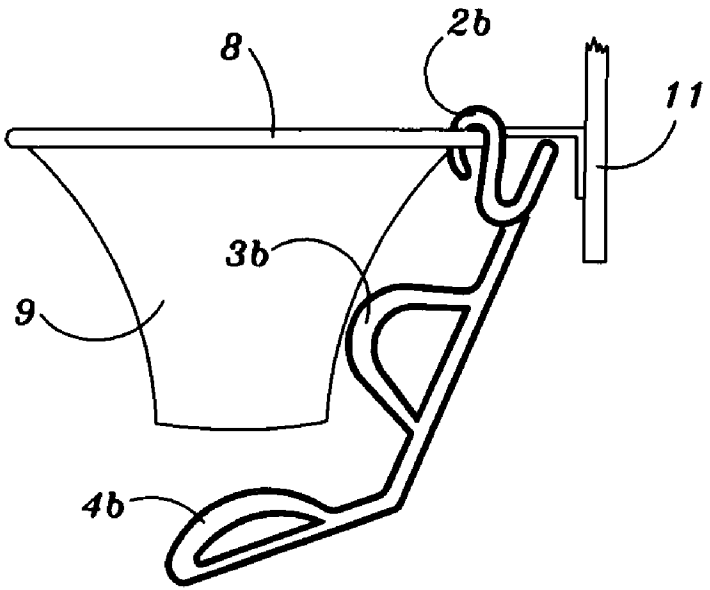
FIG. 7 is a side elevational view of FIG. 5 illustrating the device hooked over a rim.

FIG. 7 is a side view of the bell return device as it is installed on the rim 8 by hooking the left and right hooks or brackets over the rim 8. (only hook 2*b* is shown). From FIG. 7 it can also be seen that the upper wings 3*a* and 3*b* (only 3*b* is shown) and the lower wings 4*a* and 4*b* (only 4*b* is shown) are located at an angle relative to each other in a lateral direction and both pairs 3*a*, 3*b* and 4*a*, 4*b* are also located at an angle relative to each in the longitudinal direction of the spine 1.

Figure 8:
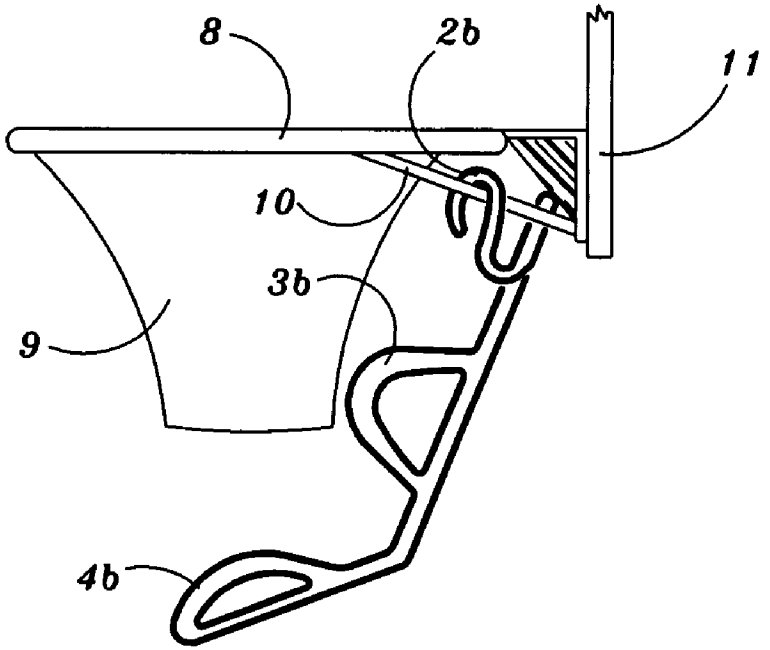
FIG. 8 is a side elevational view illustrating an alternative attachment of the the device to a rim support.

FIG. 8 is a side view of a different installation of the hoop rim itself. In this embodiment, the hoop rim 8 is supported by diagonal braces 10 attached to the hoop rim and the backboard 11 or a bracket attached to the backboard. In this embodiment the hooks or brackets 2*a* and 2*b* (only 2*b* is shown) are attached to the diagonal braces 10 and not to the hoop rim. This assures that no obstructional interferences are present on the circumference of the hoop rim.

OPERATION

With reference to FIGS. 1 and 6 it is noted that the spine is somewhat widened having elongated openings 5 therein. The widening of the spine 1 assures a more rotational stability or a lesser torque when a ball hits any of the wings 3 and 4. The presence of the elongated openings 5 assure a greater elasticity in a backward or forward motion which is highly desirable in returning a thrown ball toward the player.

As was explained above with regard to FIG. 1, the inward slants 6 and 7 on both wings 3 and 4 have proven to be extremely helpful in accurately returning a thrown ball to the player. This has shown to be quite an improvement over the previous device shown in applicant's prior U.S. Pat. No. 4,706,954, wherein the surfaces of the wing constituted round surfaces. Therefore, a round surface of a ball and a round surface of the rod of the wing could disturb, and invariably does, the contact point of the ball with the rod of the wing to thereby distort the trajectory of the ball. However, because of the inward slant of the of the wing surface, the thrown ball can never cross an inward path away from the player but must return or follow a deflected forward path toward the player. For the reasons enumerated above, the inventive device will have to be molded which is quite different from the extruded rod device of the identified Patent.

The invention claimed is:

1. A basketball return device comprising:

a flexible element having a pair of lateral upper and lower wings;

a single centrally positioned angled spine; said centrally positioned angled spine having an upper and lower section, wherein said lower section is positioned at an angle with respect to said upper section;

said pair of lateral upper and lower wings attached to said central spine at an angle;

each wing of said pair of upper and lower wings positioned at an angle with respect to each other and to the central spine;

said central spine further including a top extending upwardly from said upper wings;

a means for suspending, said means for suspending attached to said top for suspending said return device from a basketball net support, wherein said basketball net support including a hoop rim;

said central spine further including a lateral width, wherein the width of the central spine assures rotational stability when a ball hits any of the wings; and a plurality of elongated openings formed throughout the length of said lateral width of said central spine, wherein the plurality of elongated openings assure a greater elasticity in a backward or forward motion which is highly desirable when returning a thrown ball toward a player.

2. The basketball return device of claim 1, wherein said means for suspending includes two separately spaced hooks located at a top of said spine which are draped over a hoop rim of said device.

3. The basketball return device of claim 1, wherein said means for suspending includes at least two braces supporting said hoop rim including two separately spaced hooks located at a top of said spine which are draped over said braces.

4. The basketball return device of claim 3 including means for suspending said spine from said at least two braces.

* * * * *